US012751584B2

(12) United States Patent
Zhu

(10) Patent No.: US 12,751,584 B2
(45) Date of Patent: Oct. 6, 2026

(54) CONTAINER AND PUMP ASSEMBLY THEREOF

(71) Applicant: VMW INTERNATIONAL PTY LTD, New South Wales (AU)

(72) Inventor: Wei Zhu, Nantong (CN)

(73) Assignee: VMW INTERNATIONAL PTY LTD, New South Wales (AU)

( * ) Notice: Subject to any disclaimer, the term of this patent is extended or adjusted under 35 U.S.C. 154(b) by 189 days.

(21) Appl. No.: 18/847,133

(22) PCT Filed: Mar. 7, 2023

(86) PCT No.: PCT/CN2023/079954
§ 371 (c)(1),
(2) Date: Sep. 13, 2024

(87) PCT Pub. No.: WO2023/174094
PCT Pub. Date: Sep. 21, 2023

(65) Prior Publication Data

US 2025/0194862 A1 Jun. 19, 2025

(30) Foreign Application Priority Data

Mar. 14, 2022 (CN) ..... 202210247464.7

(51) Int. Cl.
*A47K 5/12* (2006.01)

(52) U.S. Cl.
CPC ..... *A47K 5/1205* (2013.01)

(58) Field of Classification Search
USPC ..... 222/420, 320–321.9, 402
See application file for complete search history.

(56) References Cited

U.S. PATENT DOCUMENTS 3,361,078 A * 1/1968 Cooprider ..... B05B 11/106
222/321.9
4,046,495 A * 9/1977 Grimm, Jr. ..... G01F 11/028
417/268

(Continued)

FOREIGN PATENT DOCUMENTS

CN 1230907 A 10/1999
CN 1239925 A 12/1999

(Continued)

OTHER PUBLICATIONS

International Search Report and Written Opinion issued for International Patent Application No. PCT/CN2023/079954, Date of mailing: Jun. 21, 2023, 14 pages including English translation.

(Continued)

*Primary Examiner* — Paul R Durand
*Assistant Examiner* — Michael J. Melaragno
(74) *Attorney, Agent, or Firm* — HSML P.C.

(57) ABSTRACT

A pump assembly (10) is provided. In the pump assembly, an inner cylinder housing (32) defines a cylindrical chamber (S1), and an annular space (S2) is defined between an outer cylinder housing (33) and the inner cylinder housing (32). An annular chamber (S3) is defined between an outer cylinder wall (13) and an inner cylinder wall (12) of a built-in member (1). A connecting part bottom wall (22) is arranged in the cylindrical chamber (S1), a connecting part side wall (23) is in slidably sealing contact with an inner wall surface (32*n*), and a piston part (24) is arranged and is in slidably sealing contact with each of an outer wall surface (12*u*) and an inner wall surface (13*n*). The built-in member (1) is configured to be movable from a lower position (PL) to a higher position (PH). A container (100) having a content discharge function is provided.

10 Claims, 9 Drawing Sheets

(56) References Cited

U.S. PATENT DOCUMENTS

| | | | | | |
|---|---|---|---|---|---|
| 4,147,476 | A * | 4/1979 | Warren | B05B 11/1074 141/117 |
| 4,286,736 | A * | 9/1981 | Corsette | B05B 11/1001 222/321.9 |
| 4,317,531 | A * | 3/1982 | Saito | B05B 11/1018 222/321.2 |
| 5,826,756 | A * | 10/1998 | Foster | B05B 11/1023 222/321.9 |
| 5,881,927 | A * | 3/1999 | Inagawa | B05B 11/1097 222/336 |
| 6,006,949 | A * | 12/1999 | Foster | B05B 11/1001 222/321.9 |
| 6,045,008 | A * | 4/2000 | Gonzalez Fernandez | B05B 11/1047 222/321.9 |
| 6,119,901 | A * | 9/2000 | Hanna | A47K 5/1205 222/372 |
| 7,353,746 | B2 * | 4/2008 | Kutella | F04B 3/003 92/61 |
| 8,827,121 | B2 * | 9/2014 | Law | B05B 11/105 222/481.5 |
| 9,687,866 | B1 * | 6/2017 | Chan | B05B 15/30 |
| 11,084,054 | B2 * | 8/2021 | Liang | B05B 11/1026 |
| 11,772,112 | B2 * | 10/2023 | Mittal | B05B 11/0044 222/372 |
| 2009/0314805 | A1 * | 12/2009 | Ding | B05B 11/106 222/321.2 |
| 2010/0006604 | A1 | 1/2010 | Ding | |
| 2015/0076176 | A1 * | 3/2015 | Ray | B05B 11/1001 222/189.11 |
| 2020/0332853 | A1 * | 10/2020 | Deman | A47K 5/1205 |
| 2020/0398296 | A1 * | 12/2020 | Zhu | B05B 11/1078 |
| 2025/0194862 | A1 * | 6/2025 | Zhu | A47K 5/1205 |

FOREIGN PATENT DOCUMENTS

| | | | |
|---|---|---|---|
| CN | 101232949 | A | 7/2008 |
| CN | 106904364 | A | 6/2017 |
| CN | 109649819 | A | 4/2019 |
| CN | 110155489 | A | 8/2019 |
| FR | 2707605 | A1 | 1/1995 |
| JP | H10318125 | A | 12/1998 |
| JP | 2000354803 | A | 12/2000 |
| JP | 2002005008 | A | 1/2002 |
| JP | 2004218556 | A | 8/2004 |
| JP | 2006297216 | A | 11/2006 |
| JP | 2009208830 | A | 9/2009 |

OTHER PUBLICATIONS

Office Action issued for Chinese Patent Application No. 202210247464.7, dated Nov. 1, 2023, 7 pages.

Office Action issued for Korean Patent Application No. 10-2024-7028626, Date of dispatch: Jan. 13, 2026, 16 pages including English machine translation.

Supplementary European Search Report issued for European Patent Application No. 23 76 9600, dated Feb. 2, 2026, 2 pages.

* cited by examiner

CONTAINER AND PUMP ASSEMBLY THEREOF

TECHNICAL FIELD

The present invention relates to a pump assembly and also relates to a container with a content discharge function.

BACKGROUND ART

Containers having a function of discharging contents such as hand sanitizers, medicines, cosmetic liquids and shampoo are often used in daily life. The content in the container can be discharged by pressing a pressing rod.

The Chinese invention patent CN 110155489 A describes a pump assembly and a container with a content discharge function. In the pump assembly of the container, an outer wall surface of a first inner housing side wall, an inner wall surface of a second inner housing side wall and an inner housing top wall define a first cavity having a first opening; a piston part is arranged in the first cavity and is in slidably sealing contact with each of the outer wall surface of the first inner housing side wall and the inner wall surface of the second inner housing side wall to divide the first cavity into a first air chamber and a second air chamber; the first air chamber is a sealed chamber jointly defined by the piston part, the inner housing top wall, the outer wall surface of the first inner housing side wall and the inner wall surface of the second inner housing side wall; and a rod body can be pressed to drive the piston part to stretch the first air chamber and compress the second air chamber, such that a content in the container body is discharged through a discharge channel. Since the piston part can rebound under the action of a resultant force of air pressure in the first air chamber and air pressure in the second air chamber to drive the rod body to rebound, the rod body is suitable for being pressed again, and a pump main body does not need to be provided with a spring for the rod body to rebound. As a result, the pump assembly can be entirely made of a plastic material without mixing any metal material, which in turn makes it easy to recycle the pump assembly.

According to the requirements on the transportation cost, packaging materials, etc., such a container often needs to allow the pressing rod to be easily pressed to the bottom, so that the entire container can have a lower height, thus occupying less space and requiring less packaging materials during transportation.

Therefore, it is necessary to provide an improved pump assembly, which makes it possible for a container including the pump assembly to allow a pressing rod to be easily pressed to the bottom without the need for a spring.

SUMMARY OF THE INVENTION

An objective of the present invention is to provide a pump assembly and a container, which makes it possible to easily press a pressing rod to the bottom while realizing rebound of the pressing rod without the need for a spring.

The present invention provides a pump assembly, suitable for being mounted on a container body, and including a pressing rod. The pressing rod has a rod body, a connecting part bottom wall, a connecting part side wall and a piston part. A lower end of the rod body is connected to the connecting part bottom wall. The connecting part side wall protrudes upwardly from the connecting part bottom wall and is arranged at a periphery of the rod body. The pump assembly further includes a main housing and a built-in member. The main housing has a bottom housing, an inner cylinder housing and an outer cylinder housing. The inner cylinder housing and the outer cylinder housing both protrude upwardly from the bottom housing. The inner cylinder housing defines a cylindrical chamber. The outer cylinder housing is located at a periphery of the inner cylinder housing and defines an annular space with the inner cylinder housing. The bottom housing is provided with a pumping port, in communication with the container body, in an intermediate part defined by the inner cylinder housing. The built-in member has a top housing wall, an inner cylinder wall and an outer cylinder wall. The inner cylinder wall and the outer cylinder wall both protrude downwardly from the top housing wall. The inner cylinder wall defines a through hole for the rod body to pass through. The outer cylinder wall is located at a periphery of the inner cylinder wall and defines an annular chamber with the inner cylinder wall. The connecting part bottom wall is arranged in the cylindrical chamber. The connecting part side wall is in slidably sealing contact with an inner wall surface of the inner cylinder housing. The piston part is arranged in the annular chamber and is in slidably sealing contact with each of an outer wall surface of the inner cylinder wall and an inner wall surface of the outer cylinder wall. The built-in member is configured to be movable in the outer cylinder housing from a lower position in which the outer cylinder wall of the built-in member is at least partially located in the annular space to a higher position in which the built-in member is arranged to be locked by means of a locking structure.

In an implementation, the outer cylinder wall and the outer cylinder housing are in sliding fit by sliding a slider in a vertical sliding groove, and the slider and the vertical sliding groove are arranged on a first one and a second one of an outer wall surface of the outer cylinder wall and an inner wall surface of the outer cylinder housing respectively.

In an implementation, the second one is provided with a circumferential sliding groove, the circumferential sliding groove being in communication with the vertical sliding groove, and in the higher position, the built-in member is locked in the higher position by sliding the slider into the circumferential sliding groove in a circumferential direction, wherein the slider and the circumferential sliding groove constitute the locking structure.

In an implementation, a protrusion is provided in the circumferential sliding groove, the protrusion having a side surface that gradually becomes higher from a proximal side to a distal side of the vertical sliding groove in the circumferential direction.

In an implementation, a raised strip extending in a vertical direction is provided on a first one of an inner wall surface of the inner cylinder wall and an outer peripheral surface of the rod body, and a groove in sliding fit with the raised strip is provided in a second one of the inner wall surface of the inner cylinder wall and the outer peripheral surface of the rod body.

In an implementation, the first one is the outer wall surface of the outer cylinder wall.

In an implementation, the pump assembly includes a plurality of sliders distributed in a circumferential direction and a plurality of corresponding vertical sliding grooves.

In an implementation, the pump assembly is configured, when the built-in member is in the lower position, to allow: the connecting part bottom wall of the pressing rod to abut against the bottom housing of the main housing, and a lower end of the outer cylinder wall of the built-in member to have a gap with the bottom housing in a vertical direction; and/or, the piston part of the pressing rod to abut against the top housing wall of the built-in member and to be located above the inner cylinder housing of the main housing.

In an implementation, the pump assembly is configured, when the built-in member is in the higher position, to allow: the pressing rod to move downwardly relative to the built-in member to abut against the bottom housing of the main housing, while the piston part to be always in sealing contact with each of the outer wall surface of the inner cylinder wall and the inner wall surface of the outer cylinder wall; and/or, a height difference between lower ends of the inner cylinder wall and the outer cylinder wall of the built-in member and an upper end of the inner cylinder housing of the main housing to be less than 10% of a height of the outer cylinder housing.

The present invention provides a container with a content discharge function and having a container body. The container further includes the pump assembly as described above, the pump assembly being mounted on the container body and configured to discharge a content in the container body.

In the pump assembly and the container described above, the piston part of the pressing rod is arranged in the annular chamber between the outer cylinder wall and the inner cylinder wall of the built-in member, so that during downward press of the pressing rod, a restoring force that causes the pressing rod to rebound upwardly can be provided due to a pressure difference between an upper side and a lower side of the piston part. Moreover, the main housing is provided with the inner cylinder housing on an inner side of the outer cylinder housing, the connecting part bottom wall is arranged in the cylindrical chamber defined by the inner cylinder housing, and the outer cylinder wall of the built-in member is aligned with the annular space between the outer cylinder housing and the inner cylinder housing, such that the pressing rod can be smoothly pressed to the bottom. Therefore, the pressing rod can be easily pressed to the bottom while realizing rebound of the pressing rod without the need for a spring. The entire pump assembly and the entire container have compact structures and thus can save package and transportation costs.

BRIEF DESCRIPTION OF THE DRAWINGS

The foregoing and other features, properties and advantages of the present invention will become more apparent from the following description made with reference to embodiments and drawings, in which.

PARTICULAR EMBODIMENTS OF THE INVENTION

The present invention will be further described below with reference to specific embodiments and the drawings, and more details are explained in the following description for the ease of fully understanding the present invention; however, the present invention can obviously be implemented in various different manners than those described herein, a person skilled in the art can make a similar extension and deduction without departing from the connotation of the present invention according to practical applications, and therefore the scope of protection of the present invention should not be limited to the content of the specific embodiments.

For example, a first feature recorded later in the specification being formed above or over a second feature may include an implementation in which the first feature and the second feature are formed via a direct contact, or may include an implementation in which an additional feature is formed between the first feature and the second feature such that the first feature and the second feature may not be in direct contact. Further, when a first element is described in connection with or in combination with a second element, the description includes an implementation in which the first element and the second element are directly connected or combined to each other, and also includes the use of one or more other intervening elements such that the first element and the second element are indirectly connected or combined to each other.

Figure 1C:
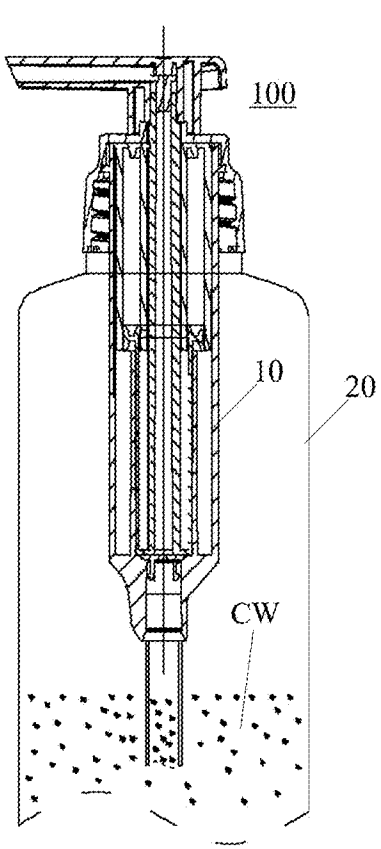
FIG. 1C is a schematic diagram showing a state in which the container has the built-in member at the highest position and the pressing rod at the lowest position.
Figure 1B:
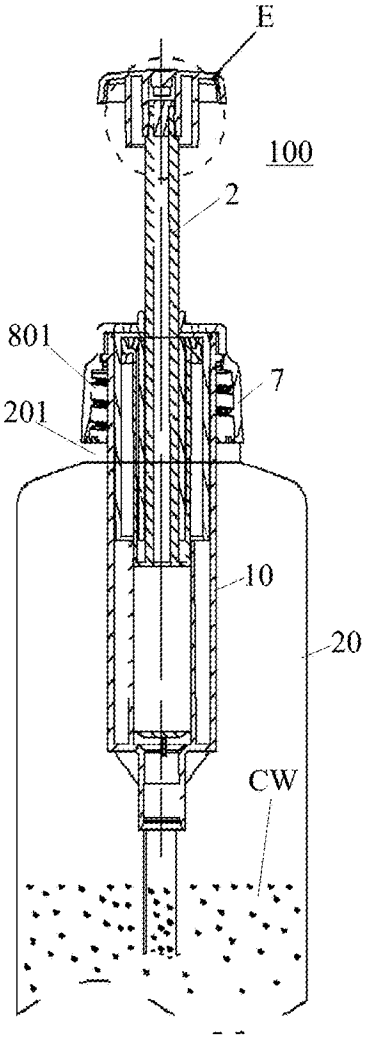
FIG. 1B is a schematic diagram showing a state in which both of the pressing rod and the built-in member in the container are at the highest positions, at which point the entire container has the largest vertical dimension.
Figure 1A:
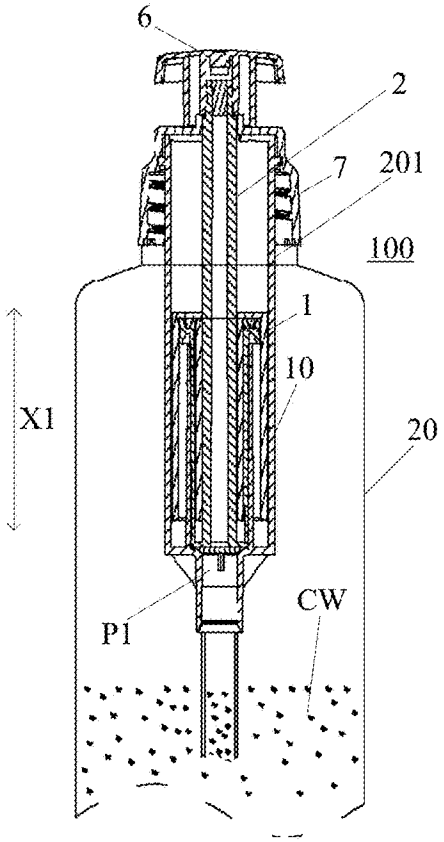
FIG. 1A is a schematic diagram showing a state in which both of a pressing rod and a built-in member in a container are at the lowest positions, at which point the entire container has the smallest vertical dimension.

FIGS. 1A, 1B, and 1C show exemplary configurations of a container 100 with a content discharge function in different states. The container 100 includes a container body 20. The container 100 further includes a pump assembly 10. The pump assembly 10 is mounted on the container body 20 and is configured to discharge a content CW in the container body 20.

FIGS. 2 to 9 show exemplary configurations of the pump assembly 10. As described above, the pump assembly 10 is suitable for being mounted on the container body 20.

It should be understood that the drawings are merely used as examples, and are not necessarily drawn to scale, and should not be taken as a limitation to the actually claimed scope of protection of the present invention.

Figure 2:
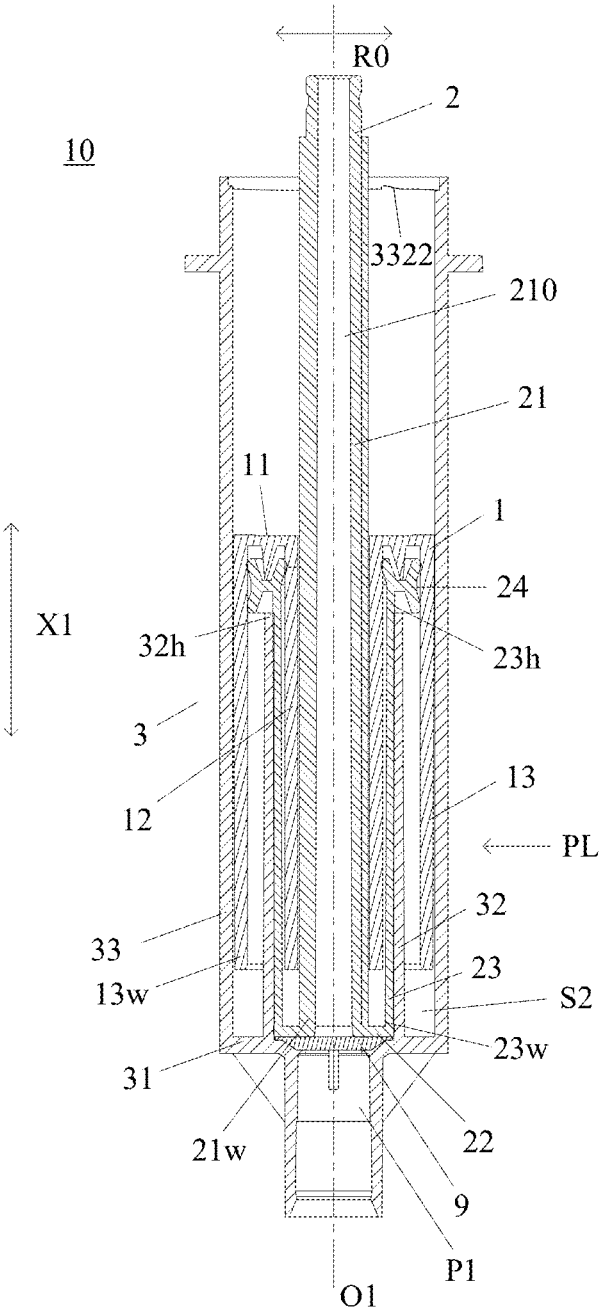
FIG. 2 is a schematic diagram showing a state in which both of a pressing rod and a built-in member in a pump assembly are at the lowest positions.
Figure 3:
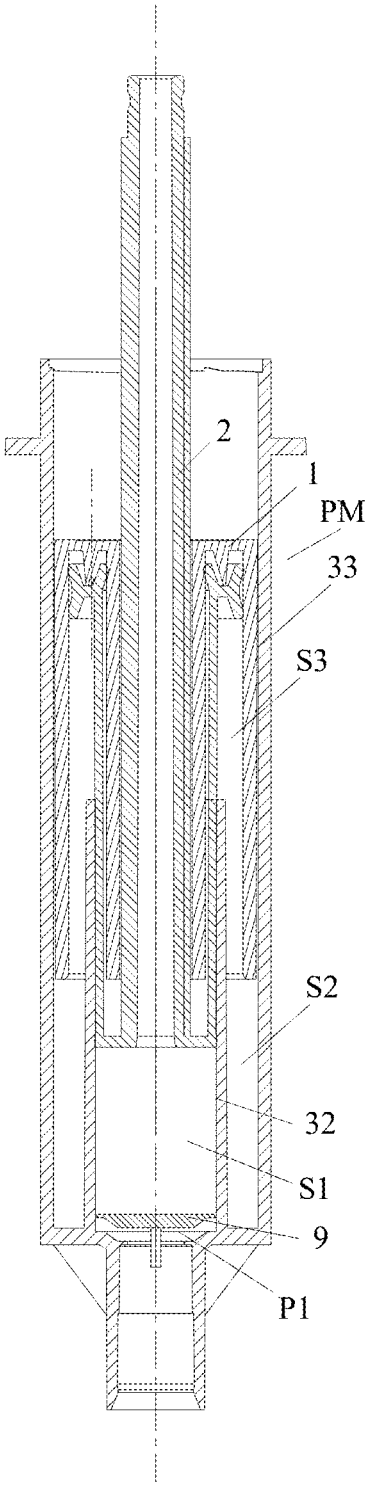
FIG. 3 is a schematic diagram showing a state in which both of the pressing rod and the built-in member in the pump assembly are at intermediate positions.
Figures 8A, 8B, 8C:
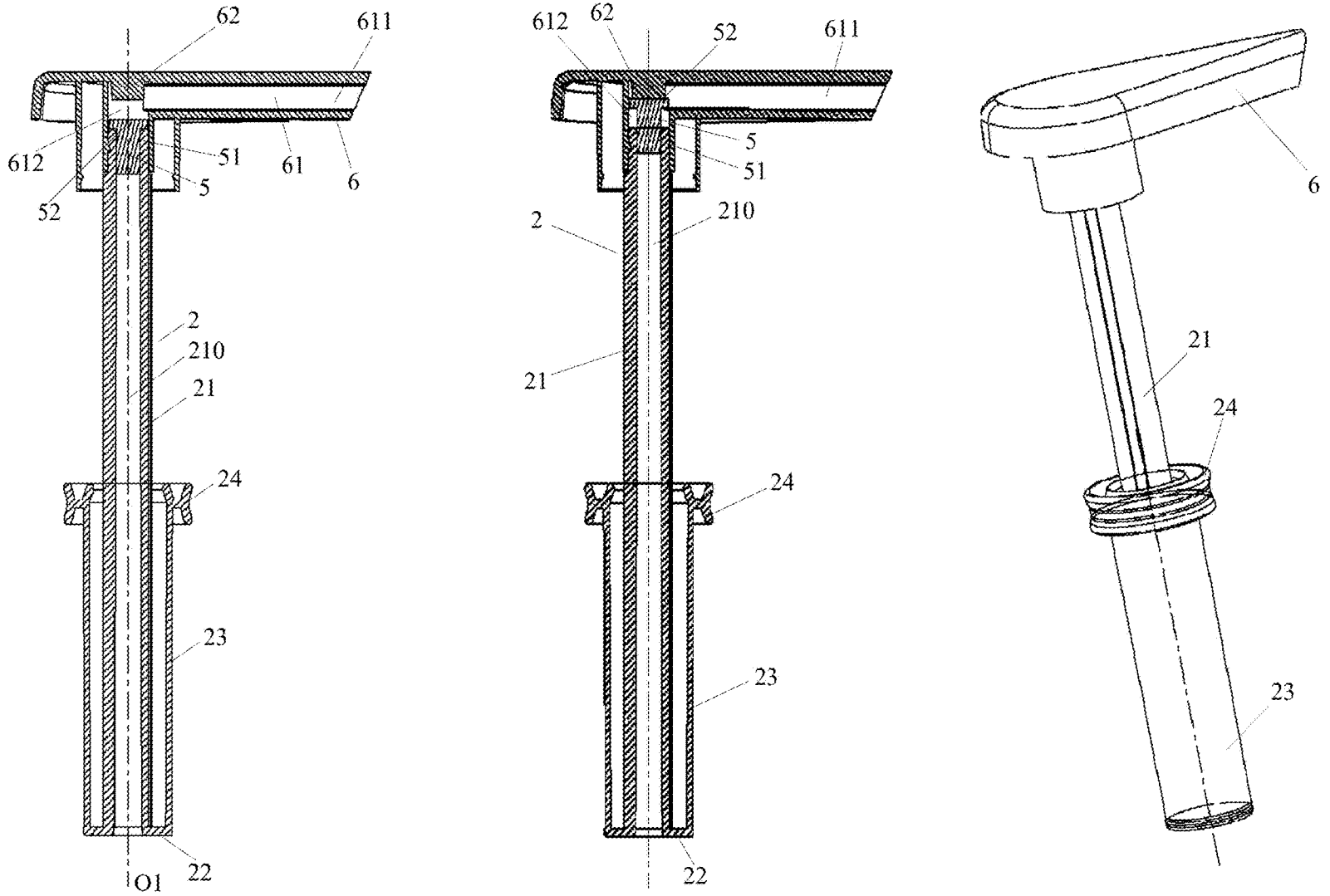
FIG. 8A is a schematic diagram showing a state in which a check valve element at a top end of the pressing rod blocks a discharge channel.
FIG. 8B is a schematic diagram showing a state in which the check valve element at the top end of the pressing rod opens the discharge channel.
FIG. 8C is a schematic diagram showing a three-dimensional configuration of the pressing rod and a head cap.

Referring to FIG. 2, the pump assembly 10 may include a pressing rod 2. FIGS. 8A to 8C show exemplary configurations of the pressing rod 2. With reference to FIGS. 2 and 8A to 8C, the pressing rod 2 is provided with a rod body 21, a connecting part bottom wall 22, a connecting part side wall 23 and a piston part 24. The rod body 21 defines a discharge channel 210. A lower end 21*w* of the rod body 21 is connected to the connecting part bottom wall 22. The connecting part side wall 23 protrudes upwardly from the connecting part bottom wall 22 and is arranged at a periphery of the rod body 21. The piston part 24 is connected to an upper end 23*h* of the connecting part side wall 23.

In the figures, the discharge channel 210 is also a rod hole of the pressing rod 2 (specifically, the rod body 21). It will be appreciated that spatial relationship terms such as "upper", "lower", "vertical", "high" and "low" are used herein to describe the relationship between one element or feature and other elements or features shown in the drawings, and refer to orientations in normal states shown in FIGS. 1A, 1B and 1C for ease of description. These spatial relationship terms are intended to include other orientations of the elements or assemblies in use or operation besides the orientations described in the drawings. For example, if the assemblies in the drawings are flipped, the orientation of the element described as being "above" another element or feature will be changed to being "below" the another element or feature. Therefore, the spatial relationship descriptors used herein should be interpreted correspondingly.

Figure 6:
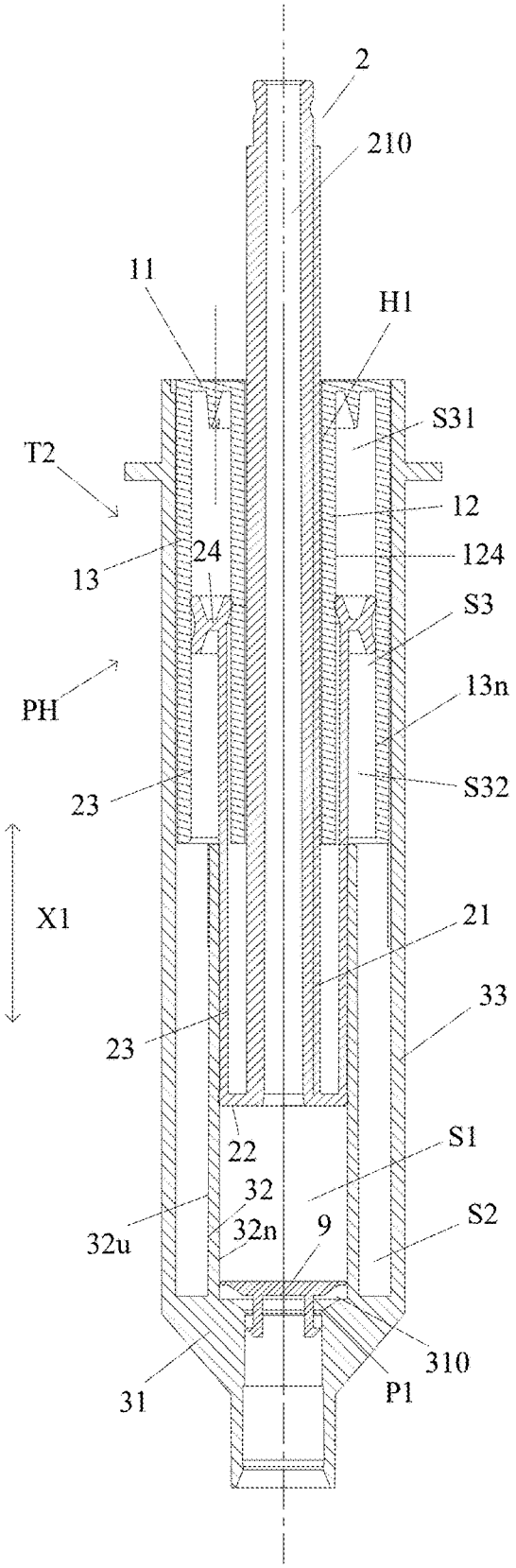
FIG. 6 is a schematic diagram showing a state in which the pump assembly has the built-in member at the highest position and the pressing rod at an intermediate position.

The pump assembly 10 may further include a main housing 3 and a built-in member 1. Referring to FIG. 6, the main housing 3 has a bottom housing 31, an inner cylinder housing 32 and an outer cylinder housing 33. Both of the inner cylinder housing 32 and the outer cylinder housing 33 protrude upwardly from the bottom housing 31. The inner cylinder housing 32 defines a cylindrical chamber S1. The outer cylinder housing 33 is located at a periphery of the inner cylinder housing 32 and defines an annular space S2 with the inner cylinder housing 32. The bottom housing 31 is provided with a pumping port P1, in communication with the container body 20, in an intermediate part 310 defined by the inner cylinder housing 32.

It can be understood that, in the illustrated implementation, a main body portion of the pump assembly 10 may be generally a revolving body revolving about a central axis O1, so for the purpose of convenience, reference may also be made below to a vertical direction X1 (an up-and-down direction in FIG. 2, i.e., a direction along the central axis O1 of the pump assembly 10), a radial direction R0 (i.e., a direction from the central axis O1 of the pump assembly 10 to a left side or a right side in FIG. 2) and a circumferential direction C0 (i.e., a direction of revolution about the central axis O1, shown in FIG. 5B and FIG. 5C) of the pump assembly 10 in FIG. 2. It should be understood that this description does not limit a specific component of the pump assembly 10 to be circular in cross section. For example, the inner cylinder housing 32 and the outer cylinder housing 33 do not necessarily mean that they are cylinders with circular cross sections, but they may be cylindrical members of which the cross sections are for example in the shapes of squares and rectangles.

With continued reference to FIG. 6, the built-in member 1 has a top housing wall 11, an inner cylinder wall 12 and an outer cylinder wall 13. Both of the inner cylinder wall 12 and the outer cylinder wall 13 protrude downwardly from the top housing wall 11. The inner cylinder wall 12 defines a through hole H1 for the rod body 21 to pass through. The outer cylinder wall 13 is located at a periphery of the inner cylinder wall 12 and defines an annular chamber S3 with the inner cylinder wall 12.

With reference to FIGS. 2 and 6, the connecting part bottom wall 22 of the pressing rod 2 is arranged in the cylindrical chamber S1. The connecting part side wall 23 of the pressing rod 2 is in slidably sealing contact with an inner wall surface 32*n* of the inner cylinder housing 32. The piston part 24 of the pressing rod 2 is arranged in the annular chamber S3 and is in slidably sealing contact with each of an outer wall surface 12*u* of the inner cylinder wall 12 and an inner wall surface 13*n* of the outer cylinder wall 13. It can be understood that the phrase "slidably sealing contact" means that two elements are slidable relative to each other while maintaining sealing between sliding-fit interfaces, which, for example, can be achieved by means of the self-deformability of a material, such as plastic, or by providing sufficient areas of the sliding-fit interfaces. For example, an external diameter of the cylindrical connecting part side wall 23 of the pressing rod 2 may be set to be slightly larger than an internal diameter of the inner cylinder housing 32 in a normal state (i.e., when no external force is applied), such that an interference fit may be formed therebetween, achieving better sealing performance. It can be further understood that by taking "the inner wall surface 32*n* of the inner cylinder housing 32" as an example, the inner wall surface 32*n* refers to a wall surface of the inner cylinder housing 32 located on an inner radial side.

The built-in member 1 is configured to be movable from a lower position PL (e.g., FIG. 2) to a higher position PH (e.g., FIG. 6) in the outer cylinder housing 33. It can be understood that the terms "lower" and "higher" are used here relative to each other.

In the lower position PL, the outer cylinder wall 13 of the built-in member 1 is at least partially located in the annular space S2. As shown in FIG. 2, most (i.e., more than 50%) of the outer cylinder wall 13 in the vertical direction X1 is located in the annular space S2, i.e., located between the inner cylinder housing 32 and the outer cylinder housing 33 in the radial direction R0.

In the higher position PH, the built-in member 1 is configured to be locked in the higher position PH by means of a locking structure 4. For example, the built-in member 1 may be provided with a radial horizontal hole extending in the radial direction R0 at a predetermined position, and the outer cylinder housing 33 may also be provided with a corresponding horizontal hole. When the built-in member 1 reaches the higher position PH, locking of the built-in member 1 can be realized by manually inserting a latch into the aforementioned radial horizontal hole and its corresponding horizontal hole to connect the built-in member 1 and the outer cylinder housing 33. That is, the radial horizontal hole, the corresponding horizontal hole and the latch can be regarded as the locking structure 4.

In the pump assembly 10 described above, the connecting part bottom wall 22 of the pressing rod 2 is arranged to move up and down in the cylindrical chamber S1 defined by the inner cylinder housing 32 of the main housing 3, such that the outer cylinder wall 13 of the built-in member 1 can move up and down in the annular space S2 between the outer cylinder housing 33 and the inner cylinder housing 32 of the main housing 3. When the built-in member 1 is not locked in the higher position PH by means of the locking structure 4, the pressing rod 2 may be depressed to the bottom, for example in the lower position PL in FIG. 2, with the built-in member 1 by means of the sealing contact between the piston part 24 and the built-in member 1. In this case, the pump assembly 10 and the entire container 100 have a small vertical dimension and a compact structure. For example, the state may be taken as a packaging state of the container 100 to save the package cost and the transportation cost. It is worth mentioning that, in this process, the pumping port P1 is always closed by a check valve element 9 (a substantially inverted cone in the figure), such that the content CW in the container body 20 would not flow out.

When there is a need for use, the pressing rod 2 can be lifted. In this case, the built-in member 1 can move upwardly in the vertical direction X1, with the pressing rod 2, from the lower position P1 in FIG. 2 to the higher position PH in FIG. 4 via the intermediate position PM in FIG. 3, and then is locked in the higher position PH by means of the locking structure 4. It is worth mentioning that, in the process from FIGS. 2 and 3 to FIG. 4, the check valve element 9 gradually opens the pumping port P1, and a part of the content CW from the container body 20 is accumulated in the cylindrical chamber S1.

Figure 4:
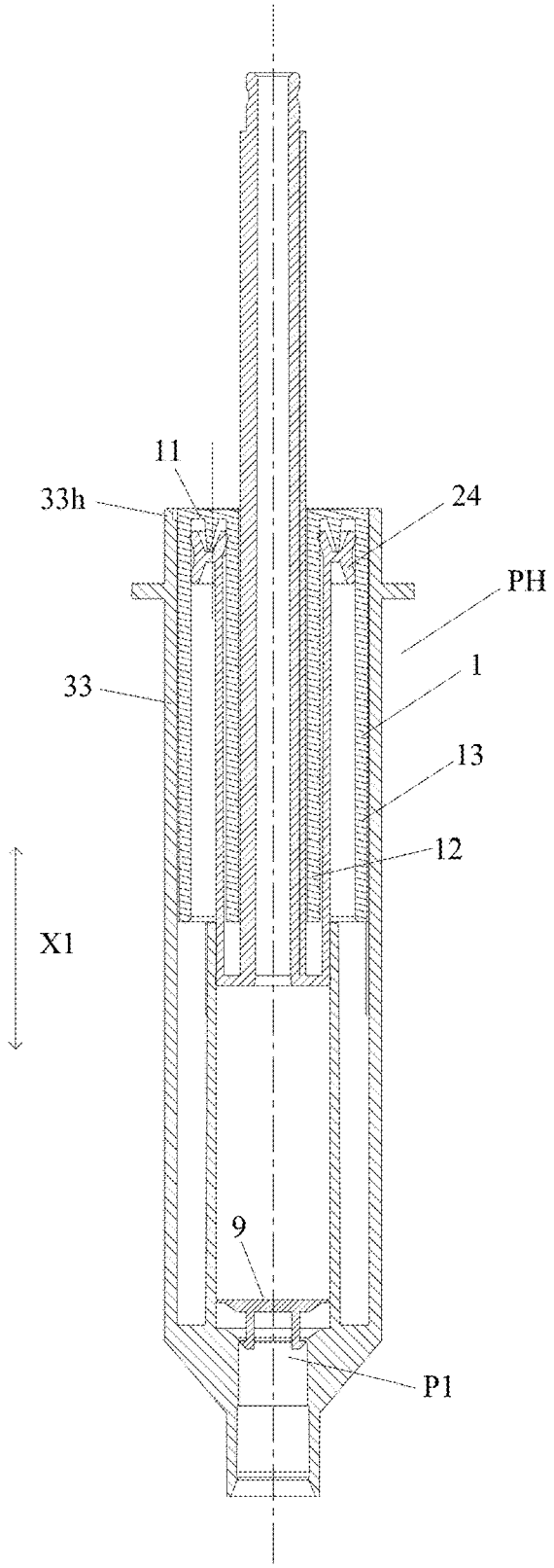
FIG. 4 is a schematic diagram showing a state in which both of the pressing rod and the built-in member in the pump assembly are at the highest positions.
Figure 7:
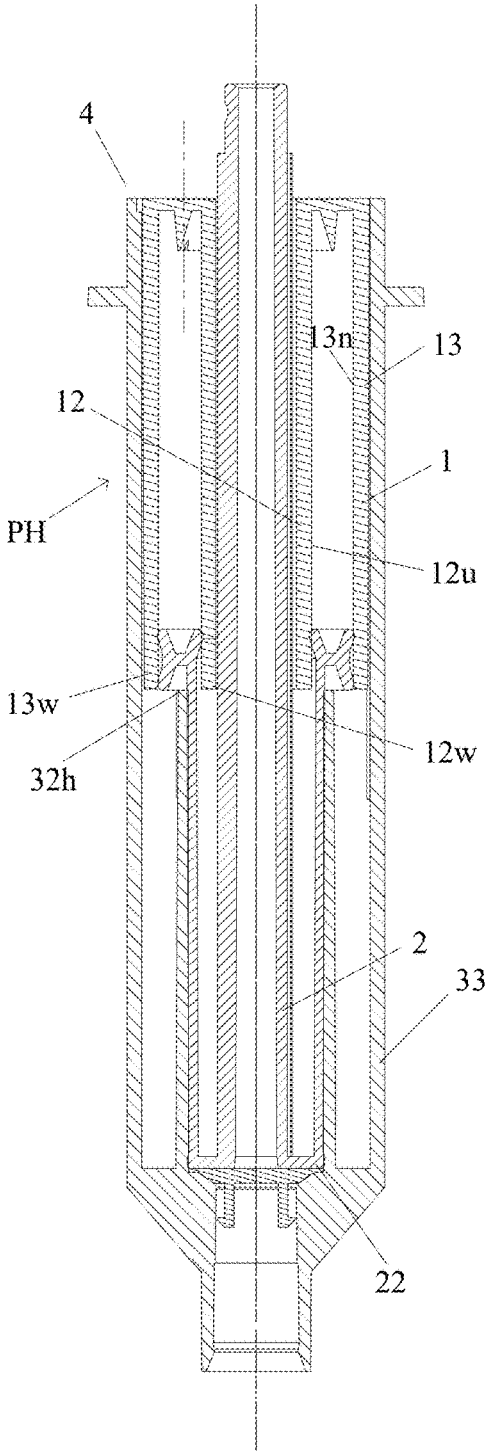
FIG. 7 is a schematic diagram showing a state in which the pump assembly has the built-in member at the highest position and the pressing rod at the lowest position.

Thereafter, the built-in member 1 remains in the higher position PH, while the pressing rod 2 may be pressed relative to the built-in member 1 from an upper position in FIG. 4 to a lower position in FIG. 7 via an intermediate position in FIG. 6. Since the piston part 24 can divide the annular chamber S3 into a lower chamber S32 and a closed upper chamber S31 in the vertical direction X1, a pressure difference between the lower chamber S32 and the upper chamber S31 gradually increases as the pressing rod 2 moves downwardly relative to the built-in member 1, thereby providing an elastic restoring force for the pressing rod 2 to rebound upwardly. It is worth mentioning that, in the process from FIGS. 4 and 6 to FIG. 7, the check valve element 9 gradually closes the pumping port P1. After the pressing rod 2 is repeatedly lifted and pressed, a sufficient amount of the content CW, accumulated in the cylindrical chamber S1, may be discharged through the discharge channel 210.

Thus, the container 100 with the pump assembly 10 described above allows the pressing rod 2 to be easily pressed to the bottom without the need for a spring.

As an example of operation, a user can press a head cap 6, which is connected to the pressing rod 2 and will be mentioned later, such that air inside the cylindrical chamber S1 passes through the discharge channel 210 in the middle of the pressing rod 2 and is then pressed out through the head cap 6. When the user does not apply any force to the head cap 6, the head cap 6 and the pressing rod 2 would rebound and rise under the action of the restoring force formed by the pressure difference between the lower chamber S32 and the upper chamber S31, forming a negative pressure inside the cylindrical chamber S1. Therefore, the content CW in the container body 20, for example, a liquid, can be sucked into the cylindrical chamber S1 through the pumping port P1 until the cylindrical chamber is full. When the head cap 6 and the pressing rod 2 are depressed again by the user after the cylindrical chamber is full, the liquid in the cylindrical chamber S1 is pressed by the connecting part bottom wall 22 of the pressing rod 2 and pumped out through the discharge channel 210 of the pressing rod 2 and the head cap 6. Reference may be made to Chinese invention patent CN 109649819 A for the specific process of discharge of the content by pressing, which will not be repeated here.

It can be understood that two orientations "perpendicular", "consistent", "parallel" and the like mentioned herein do not need to meet the strict requirements for angles in the mathematical sense, but allow a certain tolerance range, for example, it differs from the angle required in the mathematical sense by 20° or less. In addition, the expression of "along a direction" or "in a direction" means that there is at least a component in this direction, preferably at an included angle of 45° or less, or more preferably at an included angle of 20° or less, or even at an included angle of 10° or less, or at an included angle of 5° or less in this direction. It can be further understood that unless otherwise stated, all ranges mentioned herein include the mentioned endpoint values.

In the illustrated implementation, the built-in member 1 is movable between the higher position PH and the lower position PL in the outer cylinder housing 33 by means of a sliding fit between the outer cylinder wall 13 and the outer cylinder housing 33.

It can be understood that specific expressions are used herein to describe the implementations of the present invention, such as "an implementation" "another implementation" and/or "some implementations", which are intended to mean a certain feature, structure, or characteristic associated with at least one implementation of the present invention. Therefore, it should be emphasized and noted that "an implementation" or "another implementation" mentioned in two or more different positions in this specification does not necessarily refer to the same implementation. In addition, some of the features, structures, or characteristics of one or more implementations of the present invention can be combined as appropriate.

Figure 5A:
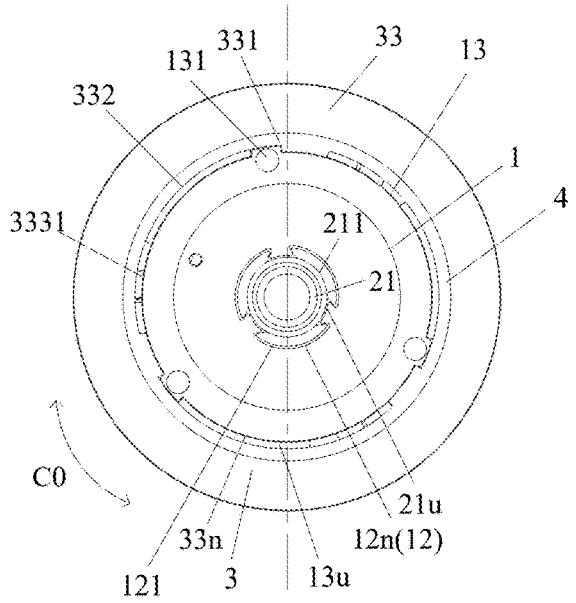
FIG. 5A is a top view showing that a slider of an outer cylinder wall of the built-in member matches a vertical sliding groove of an outer cylinder housing of a main housing.
Figure 9:
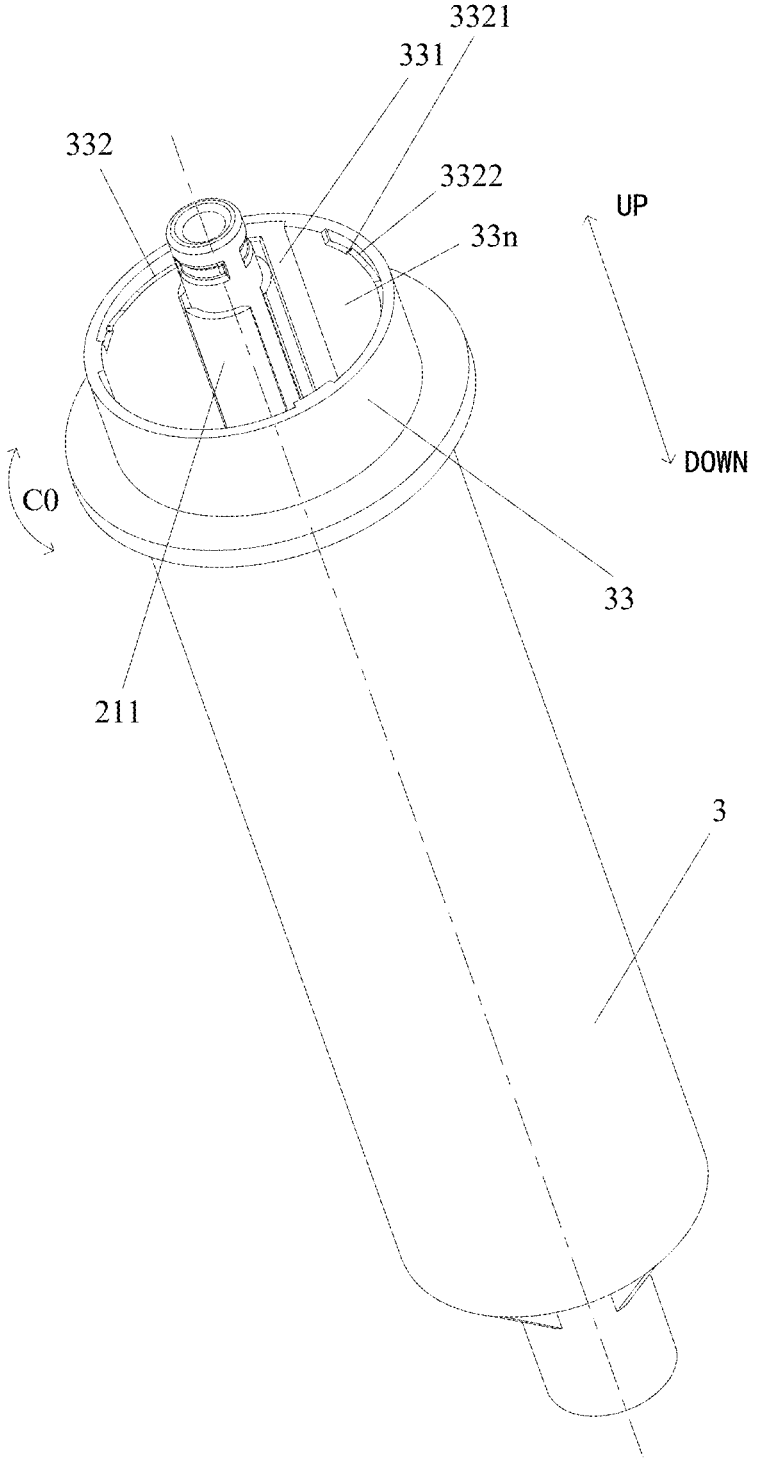
FIG. 9 is a perspective view showing a three-dimensional configuration of the outer cylinder housing of the main housing and a rod body of the pressing rod.

Referring to FIGS. 5A and 9, the outer cylinder wall 13 and the outer cylinder housing 33 can be in sliding fit by sliding a slider 131 in a vertical sliding groove 331. The slider 131 and the vertical sliding groove 331 can be arranged on a first one and a second one of an outer wall surface 13*u* of the outer cylinder wall 13 and an inner wall surface 33*n* of the outer cylinder housing 33, respectively. That is, the slider 131 is arranged on the outer wall surface 13*u* of the outer cylinder wall 13, and the vertical sliding groove 331 is arranged on the inner wall surface 33*n* of the outer cylinder housing 33. The slider 131 may also be arranged on the inner wall surface 33*n* of the outer cylinder housing 33, and in this case, the vertical sliding groove 331 is arranged on the outer wall surface 13*u* of the outer cylinder wall 13. In the illustrated implementation, the first one described above is the outer wall surface 13*u* of the outer cylinder wall 13. That is, the second one is the inner wall surface 33*n* of the outer cylinder housing 33.

It should be understood that the terms "first", "second", etc. are used herein to limit features only for the purpose of facilitating distinction between corresponding features, and unless otherwise stated, the above terms have no special meaning and therefore cannot be interpreted as limiting the scope of protection of the present invention.

With continued reference to FIG. 9, the inner wall surface 33*n* of the outer cylinder housing 33 (as an example of the second one described above) may be provided with a circumferential sliding groove 332. The circumferential sliding groove 332 may be in communication with the vertical sliding groove 331. In the higher position PH, the built-in member 1 may be locked in the higher position PH by sliding the slider 131 into the circumferential sliding groove 332 in the circumferential direction C0. The slider 131 and the circumferential sliding groove 332 constitute the locking structure 4 described above. It can be understood that the circumferential sliding groove 332 is also a hanging groove extending in the circumferential direction C0.

The pump assembly 10 may include a plurality of sliders 131 distributed in the circumferential direction C0 and a plurality of corresponding vertical sliding grooves 331. It can be understood that "a plurality of" herein means more than two, including two, three, four, five, etc. In FIG. 5A, the pump assembly 10 may include three sliders 131 distributed in the circumferential direction C0 and three corresponding vertical sliding grooves 331. Further, the pump assembly 10 may further include three circumferential sliding grooves 332 which are in communication with the three vertical sliding grooves 331 respectively.

With continued reference to FIG. 9, a protrusion 3321 is provided in the circumferential sliding groove 332. The protrusion 3321 has a side surface 3322 (also shown in FIG. 2) that gradually becomes higher from a proximal side to a distal side of the vertical sliding groove 331 in the circumferential direction C0. The proximal side of the vertical sliding groove 331 is also a side of the vertical sliding groove 331 close to the corresponding circumferential sliding groove 332, and the distal side is also a side of the vertical sliding groove 331 away from the corresponding circumferential sliding groove 332. In FIG. 5A, for each vertical sliding groove 331, the corresponding circumferential sliding groove 332 extends counterclockwise from the vertical sliding groove 331 in the circumferential direction C0.

With reference to FIGS. 5A and 9, a raised strip 211 extending in the vertical direction X1 is provided on a first one of an inner wall surface 12*n* of the inner cylinder wall 12 and an outer peripheral surface 21*u* of the rod body 21, and a groove 121 in sliding fit with the raised strip 211 is provided in a second one of the inner wall surface 12*n* of the inner cylinder wall 12 and the outer peripheral surface 21*u* of the rod body 21. In the illustrated implementation, for example, the outer peripheral surface 21*u* of the rod body 21 is the first one described above, and the inner wall surface 12*n* of the inner cylinder wall 12 is the second one described above. That is, the raised strip 211 extending in the vertical direction X1 is provided on the outer peripheral surface 21*u* of the rod body 21, and the groove 121 in sliding fit with the raised strip 211 is provided in the inner wall surface 12*n* of the inner cylinder wall 12. In this way, the built-in member 1 and the pressing rod 2 may be in sliding fit by means of the groove 121 and the raised strip 211, and can not rotate relative to each other.

Referring to FIG. 2, the pump assembly 10 is configured, when the built-in member 1 is in the lower position PL, to allow the connecting part bottom wall 22 of the pressing rod 2 to abut against the bottom housing 31 of the main housing 3, i.e., to abut against the bottom housing 31 via the check valve element 9 in FIG. 2. When the built-in member 1 is in the lower position PL, the pump assembly 10 may also allow a lower end 13*w* of the outer cylinder wall 13 of the built-in member 1 to have a gap with the bottom housing 31 in the vertical direction X1. In other words, when the connecting part bottom wall 22 of the pressing rod 2 abuts against the bottom housing 31 of the main housing 3, it can be considered that the built-in member 1 is in the lower position PL. In this case, the lower end 13*w* of the outer cylinder wall 13 of the built-in member 1 does not abut against the bottom housing 31, but has a gap with the bottom housing 31 in the vertical direction X1.

When the built-in member 1 is in the lower position PL, the pump assembly 10 may also allow the piston part 24 of the pressing rod 2 to abut against the top housing wall 11 of the built-in member 1 and to be located above the inner cylinder housing 32 of the main housing 3. That is, a top part of the piston part 24 of the pressing rod 2 may abut against a bottom surface of the top housing wall 11 of the built-in member 1, and the two cannot continue to move toward each other. When the connecting part bottom wall 22 of the pressing rod 2 abuts against the bottom housing 31 of the main housing 3, a bottom part of the piston part 24 of the pressing rod 2 may not interfere with an upper end 32*h* of the inner cylinder housing 32 of the main housing 3. In FIG. 2, the piston part 24 of the pressing rod 2 is in close proximity to the upper end 32*h* of the inner cylinder housing 32 of the main housing 3, for example, the distance between the lowest point of the piston part 24 and the upper end 32*h* of the inner cylinder housing 32 does not exceed 5 mm, and is further close to zero. This can be achieved by a specific dimensional fit.

Referring to FIG. 7, the pump assembly 10 is configured, when the built-in member 1 is in the higher position PH, to allow the pressing rod 2 to move downwardly relative to the built-in member 1 to abut against the bottom housing 31 of the main housing 3 (for example, from FIG. 4 to FIG. 7 via FIG. 6), while the piston part 24 to be always in sealing contact with each of the outer wall surface 12*u* of the inner cylinder wall 12 and the inner wall surface 13*n* of the outer cylinder wall 13. That is, the piston part 24 never leaves the annular chamber S3 between the inner cylinder wall 12 and the outer cylinder wall 13. In addition, as shown in FIG. 7, when the built-in member 1 is in the higher position PH, the pump assembly 10 may also allow a height difference between a lower end 12*w* of the inner cylinder wall 12 and a lower end 13*w* of the outer cylinder wall 13 of the built-in member 1 and an upper end 32*h* of the inner cylinder housing 32 of the main housing 3 to be less than 10% of a height of the outer cylinder housing 33. It can be understood that the lower end 13*w* of the outer cylinder wall 13 may be higher than the upper end 32*h* of the inner cylinder housing 32, and may also be lower than or flush with the upper end 32*h* of the inner cylinder housing 32. For example, in FIG. 7, the lower end 12*w* of the inner cylinder wall 12 and the lower end 13*w* of the outer cylinder wall 13 of the built-in member 1 are approximately at the same height, and are both approximately flush with the upper end 32*h* of the inner cylinder housing 32 of the main housing 3. This can be achieved by a specific dimensional fit.

Referring to FIGS. 1B, 8A and 8B, a check valve element 5 that allows a fluid to flow out from the discharge channel 210 is provided at a top end of the discharge channel 210.

In other words, the check valve element 5 is provided at an upper end of the pressing rod 2 of the container 100, allowing the content CW in the container 100 to unidirectionally flow out from the discharge channel 210 of the pressing rod 2. That is, the check valve element 5 allows the content CW to flow out from the discharge channel 210 of the pressing rod 2 but prevents the content CW from flowing from the outside into the discharge channel 210 of the pressing rod 2.

The container 100 may further include a head cap 6, and the head cap 6 may constitute a press cap assembly together with the pressing rod 2, the check valve element 5, etc.

Figure 10:
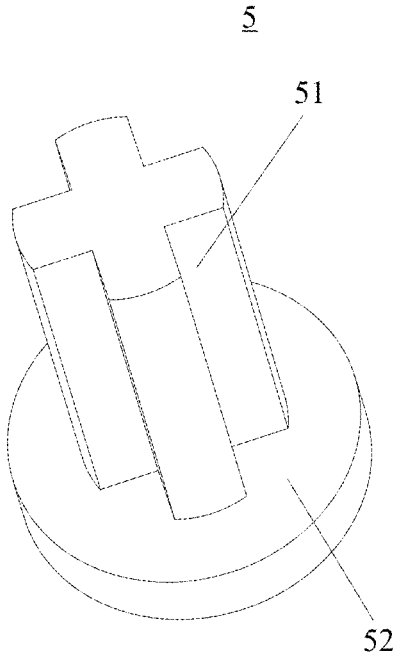
FIG. 10 is a perspective view of the check valve element at the top end of the pressing rod.
Figure 11:
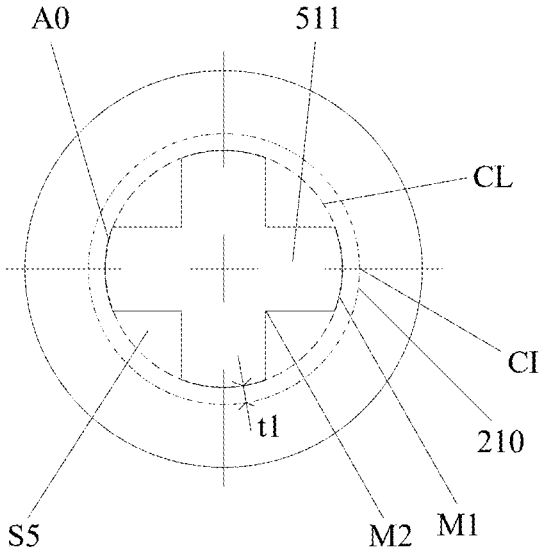
FIG. 11 is a top view of the check valve element in FIG. 10.

FIG. 10 shows a three-dimensional configuration of the check valve element 5 that is inverted, while FIG. 11 shows a top-view configuration of the check valve element 5. The check valve element 5 includes a column portion 51 and a cover portion 52. As shown in FIG. 8B, the cover portion 52 is connected to an upper end of the column portion 51. In FIG. 11, a cross section of the column portion 51 of the check valve element 5 can be seen, and a cross section of the discharge channel 210, i.e., a hole section of the rod hole of the pressing rod 2 (specifically, the rod body 21), is particularly illustrated. The cross section is a section perpendicular to an extension direction of the column portion 51 or an extension direction of the discharge channel 210 (i.e., a depth direction of the rod hole), i.e., a section extending in a horizontal direction in the state of FIG. 1A.

As shown in FIG. 11, an outer contour of the cross section of the column portion 51 includes a plurality of points, for example, points M1. The plurality of points are located on the same circle line CL. Points, for example, points M2, on the outer contour other than the plurality of points described above are located inside the circle line CL. In FIG. 11, the circle line CL is shown by a dotted line. It can be understood that the plurality of points described above may be points separated from one another. The plurality of points described above may also be partially continuous points, and thus may form a curve.

The circle line CL is proportionally smaller than a contour line CI of the cross section of the discharge channel 210. In FIG. 11, the contour line CI is shown by a dot dash line. That is, the circle line CL may be obtained by reducing the contour line CI as a whole. For example, the contour line CI may be reduced to 98%, thus resulting in the circle line CL. That is, the circle line CL has the same shape as the contour line CI, but has a smaller size than the contour line CI.

Referring to FIG. 8A, the check valve element 5 has the column portion 51 inserted into the discharge channel 210, and the cover portion 52 resting on the pressing rod 2 to block the discharge channel 210. Therefore, the column portion 51 can be located in the discharge channel 210 by means of the plurality of points M1 described above, and defines a circulation channel S5 with the discharge channel 210 by means of the other points M2 described above for the content CW to pass through.

The aforementioned check valve element 5 of which the column portion 51 has a cross section in a specific shape can provide the circulation channel S5 for the content CW to pass through. In addition, by means of the plurality of points M1 described above, the column portion 51 can be stably arranged in the discharge channel 210 and thus is not easily shaken.

In the aforementioned check valve element 5, the discharge channel 210 may be a round hole. That is, the discharge channel 210 has a circular cross section. The outer contour of the cross section of the column portion 51 may include a plurality of separate arc segments A0. The plurality of arc segments A0 may all be located on the circle line CL, and the plurality of points M1 described above may constitute the plurality of arc segments A0. In this case, the plurality of points described above are grouped into a plurality of groups of points, and each group of points are continuously distributed to form one arc segment A0.

Referring to FIGS. 10 and 11, the outer contour of the cross section of the column portion 51 may be cross-shaped. Further, the outer contour is cross-shaped and may also include a plurality of arc segments A0. That is, the plurality of arc segments A0 are four arc segments A0, and each arc segment A0 constitutes an outermost surface of each spoke 511 of four outwardly radiating spokes 511 of the cross. In another implementation, a line of the outermost surface of each spoke 511 constituting the cross may also be a straight line segment, and two end points of the straight line segment belong to the plurality of aforementioned points and are both located on the circle line CL.

With reference to FIGS. 10 and 11, the cover portion 52 may be plate-shaped. As shown in FIG. 11, an outer contour of a cross section of the cover portion 52 may contain the contour line CI of the discharge channel 210, thereby blocking the discharge channel 210, which can be seen in FIG. 8A.

In the figure, an outer peripheral surface of the column portion 51 may be a columnar surface. It can be understood that the columnar surface is a curved surface formed by parallel movement of a movable straight line along a fixed curve. In addition, the movable straight line is called a straight generatrix of the columnar surface, and the fixed curve is called a directrix of the columnar surface. For the outer peripheral surface of the column portion 51, the fixed curve is a closed curve. That is, all the cross sections of the column portion 51 are the same, not only in shape but also in angular position.

Referring to FIG. 11, a distance t1 between the circle line CL and the contour line CI may be 0.1 mm or less. In the case where the circle line CL is a circular ring in the illustrated implementation, a radius of the circle line CL is less than a radius of a circular hole as the discharge channel 210 by 0.1 mm or less. Practices show that setting a minimum gap between the column portion 51 and the discharge channel 210 to be 0.1 mm or less can stably position the check valve element 5 in the discharge channel 210 of the pressing rod 2.

In the press cap assembly constituted by the pressing rod 2, the head cap 6, etc., the head cap 6 has a lead-out channel 61, the pressing rod 2 has the discharge channel 210, and the pressing rod 2 is connected to the head cap 6. The press cap assembly may further include the aforementioned check valve element 5. The cover portion 52 of the check valve element 5 is received in the lead-out channel 61 of the head cap 6, and the column portion 51 of the check valve element 5 is inserted into the discharge channel 210 of the pressing rod 2, thereby allowing the content CW in the container 100 to unidirectionally flow from the discharge channel 210 to the lead-out channel 61.

In the illustrated implementation, the lead-out channel 61 may include a vertical hole 612 and a horizontal hole 611. A lower end of the vertical hole 612 may be in communication with the discharge channel 210 (an upper end of the discharge channel 210 in FIG. 8A), an upper end of the vertical hole 612 is in communication with the horizontal hole 611 (a left end of the horizontal hole 611 in FIG. 8A), and the cover portion 52 of the check valve element 5 is received in the vertical hole 612.

Figure 12:
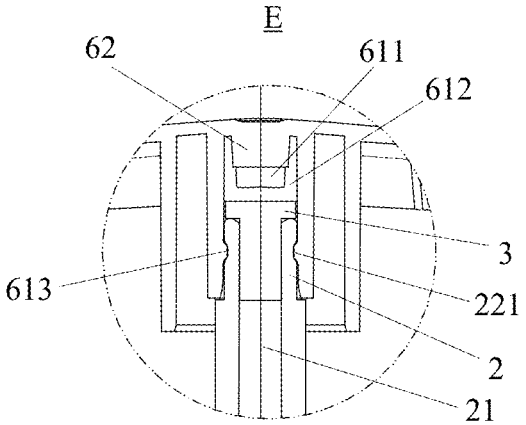
FIG. 12 is a partial enlarged view of part E in FIG. 1B.

FIG. 8A shows the state of the press cap assembly as viewed from the right side in FIG. 1B, while FIG. 12 shows a partial enlarged configuration of part E in FIG. 1B. With reference to FIGS. 8A and 12, a boss 62 protruding downwardly is arranged in the vertical hole 612. In the figures, the boss 62 protrudes downwardly from a top surface of the vertical hole 612. The boss 62 covers a part of a cross section of the horizontal hole 611. That is, the boss 62 protrudes to a sufficient height to cover a part of the cross section of the horizontal hole 611, for example, to cover 50% of the cross section in height. The cover portion 52 of the check valve element 5 is configured to abut against a lower end of the boss 62 and thus stop continuously moving upwardly, as shown in FIG. 8B. By providing the boss 62, the cover portion 52 can be effectively prevented from deflecting into the horizontal hole 611.

As can be seen in FIG. 12, the upper end of the pressing rod 2 is snapped into the vertical hole 612, thereby connecting the pressing rod 2 to the head cap 6. In the figure, a recess 221 may be provided in the outer peripheral surface of the upper end of the pressing rod 2, and a protrusion 613 may be provided on an inner surface of the vertical hole 612. The upper end of the pressing rod 2 is inserted into the vertical hole 612, and by snapping the protrusion 613 into the recess 221, the pressing rod 2 is engaged with the head cap 6.

The following is an exemplary description of the movement of the aforementioned check valve element 5 in the container 100. Initially, the check valve element 5 rests at the upper end of the pressing rod 2 by means of the cover portion 52 due to gravity, as shown in FIG. 8A. In the process of pressing the pressing rod 2 from FIG. 4 to FIG. 7 via FIG. 6, air or the content CW may move upwardly from the discharge channel 210 of the pressing rod 2, and would jack up the check valve element 5, from FIG. 8A to FIG. 8B, when reaching the upper end of the pressing rod 2. In this case, the content CW reaches the horizontal hole 611 through the circulation channel S5 defined between the other points M2 described above and the discharge channel 210 (a wall of the rod hole), and then through the gap between the cover portion 52 and the vertical hole 612, and thus is led out through the lead-out channel 61.

As a specific example, for example, a vertical length of the column portion 51 of the check valve element 5 may be 5.9 mm, the cover portion 52 is a circular plate of which the diameter may be for example 4.9 mm and a vertical thickness may be for example 1 mm, a diameter of the circle line CL may be for example 2.93 mm, and a hole diameter of the discharge channel 210 may be for example 3 mm. The aforementioned check valve element 5 can be stably placed in the discharge channel 210 of the pressing rod 2 and thus is not easily shaken. Moreover, the aforementioned check valve element 5 has a simple structure, is easy to manufacture, and has a low cost.

The container 100 may further include a gland 7, the gland 7 may form the press cap assembly with the head cap 6 and the like, and the press cap assembly may further include the pressing rod 2. The pressing rod 2 is pressably arranged on the container body 20 in the vertical direction X1 (i.e., an up-and-down direction). The vertical direction X1 is also a direction along the central axis O1 of the container 100, the pump assembly 10, the pressing rod 2, etc., which may also be called an axial direction of the container 100, the pump assembly 10 and the pressing rod 2 and is also a direction of press movement of the pressing rod 2.

Figure 13:
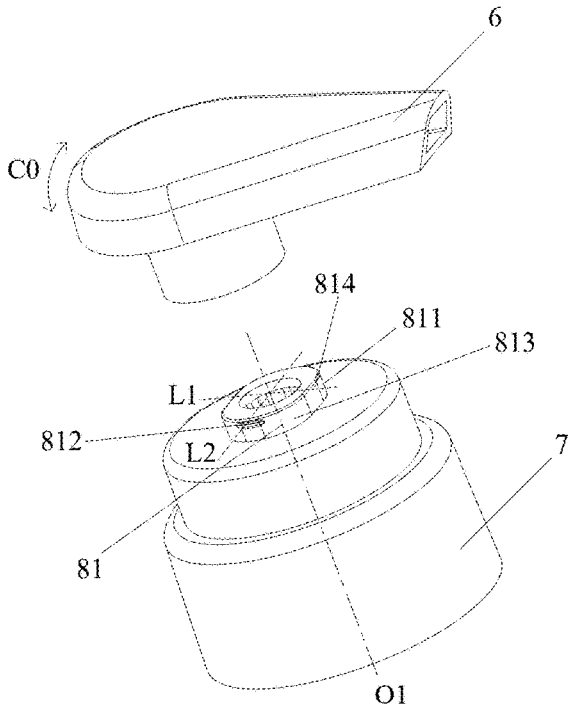
FIG. 13 is a perspective view showing an exploded configuration of the head cap and a gland.

FIG. 13 shows an exploded configuration of the head cap 6 and the gland 7. The gland 7, also commonly referred to as a large ring, may be mounted on the container body 20, and the head cap 6 is connected to the pressing rod 2, as shown in FIG. 1B.

A first one of the gland 7 and the head cap 6 may have an adapter column 81. A recess 812 is provided on an outer columnar surface 811 of the adapter column 81. A second one of the gland 7 and the head cap 6 has an adapter hole 82, and a protrusion 822 is provided on an inner surface 821 of the adapter hole 82. In the illustrated implementation, the aforementioned first one is the gland 7, that is, the aforementioned second one is the head cap 6. The following describes an example in which the adapter column 81 is arranged on the gland 7 and the adapter hole 82 is arranged in the head cap 6.

Figure 14:
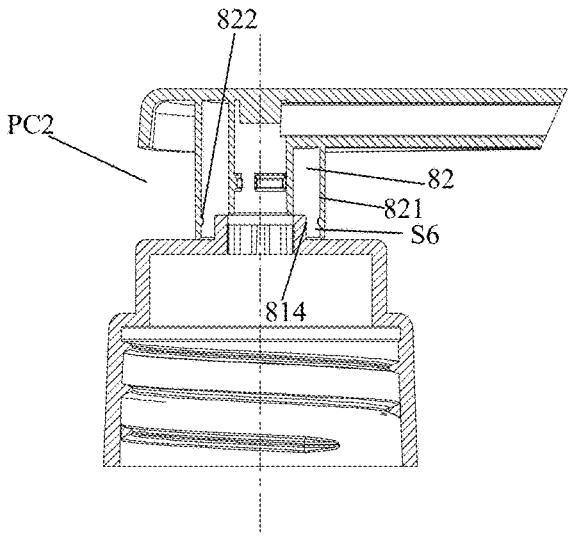
FIG. 14 is a schematic diagram showing a state in which a protrusion of the head cap is located in an avoidance space.
Figure 15:
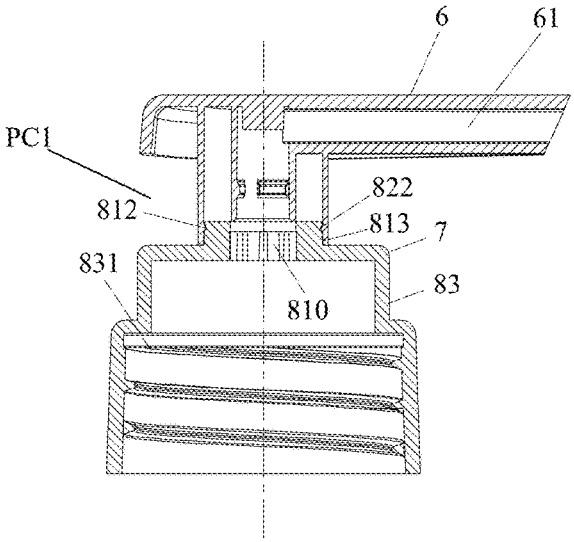
FIG. 15 is a schematic diagram showing a state in which the protrusion of the head cap is snapped into a recess of the gland.

With reference to FIGS. 13 to 15, the adapter column 81 is configured to be inserted into the adapter hole 82, and the head cap 6 is configured to switch from a first position PC1 (as shown in FIG. 15) to a second position PC2 (as shown in FIG. 14) relative to the gland 7 in the circumferential direction C0. As shown in FIG. 15, in the first position PC1, the protrusion 822 is snapped into the recess 812, thereby limiting movement of the head cap 6 relative to the gland 7 in the vertical direction X1. As shown in FIG. 14, in the second position PC2, the protrusion 822 is located in an avoidance space S6 formed between the outer columnar surface 811 of the adapter column 81 and the inner surface 821 of the adapter hole 82, allowing the head cap 6 to move relative to the gland 7 in the vertical direction X1. It can be understood that the circumferential direction C0 is also a direction around a route of the press movement of the pressing rod 2.

When in use, the head cap 6 may be located in the first position PC1 relative to the gland 7. In this case, the protrusion 822 of the head cap 6 is snapped into the recess 812 of the gland 7, and the head cap 6 cannot move relative to the gland 7 in the vertical direction X1, such that the head cap 6 is fixed relative to the gland 7 in the vertical direction X1. That is, the head cap cannot move relative to the gland 7 in the vertical direction X1 at least when there is not enough external force. Therefore, the pressing rod 2 cannot be pressed relative to the container body 20, i.e., remains in place. The head cap 6 is rotated from the first position PC1 to the second position PC2 relative to the gland 7 such that the protrusion 822 is located in the avoidance space S6 formed between the outer columnar surface 811 of the adapter column 81 and the inner surface 821 of the adapter hole 82, allowing the head cap 6 to move relative to the gland 7 in the vertical direction X1, i.e., the pressing rod 2 may be flexibly pressed relative to the container body 20.

Referring to FIG. 13, the outer columnar surface 811 of the adapter column 81 may include an arc columnar surface 813 with an arc line as a directrix and an avoidance columnar surface 814 with a line recessed relative to the arc line as a directrix. The avoidance columnar surface 814 may be continuously connected to the arc columnar surface 813, i.e., the avoidance columnar surface 814 is adjacent to the arc columnar surface 813. The recess 812 may be arranged in the arc columnar surface 813.

A directrix of the arc columnar surface 813 is an arc line, and a directrix of the avoidance columnar surface 814 is a line recessed relative to the arc line. As mentioned above, the directrix is a fixed curve that forms the columnar surface. That is, the line as the directrix of the avoidance columnar surface 814 may be any curve, including a straight line, which is indented toward the central axis O1 relative to the arc line. The only requirement is that any point of the curve is closer to the central axis O1 relative to the arc line. In the illustrated implementation, the line is a straight line, i.e., the avoidance columnar surface 814 is a flat surface.

The inner surface 821 of the adapter hole 82 may be a cylindrical surface adapted to the arc columnar surface 813 of the adapter column 81. That is, if the adapter column 81 is complemented as a complete cylinder along the circular line where the arc line of the arc columnar surface 813 is located, the adapter hole 82 may be in clearance fit with the cylinder. For example, an aperture of the adapter hole 82 may be larger than a diameter of the cylinder by 1 mm or less. In this way, the inner surface 821 of the adapter hole 82 may be adapted to the arc columnar surface 813 of the adapter column 81. When the protrusion 822 is ignored, the adapter column 81 may fit exactly into the adapter hole 82.

As shown in FIG. 14, in the second position PC2, the protrusion 822 may be located in the avoidance space S6 formed between the avoidance columnar surface 814 and the inner surface 821.

In the above arrangement, by means of the fit and positioning between the arc columnar surface 813 whose directrix is an arc line and the adapter hole 82, and the avoidance space S6 is formed between the avoidance columnar surface 814 whose directrix is recessed relative to the arc line and the inner surface 821, so that the protrusion 822 can be accommodated without hindering the movement of the head cap 6 relative to the gland 7 in the vertical direction X1.

It can be understood that switching of the head cap 6 from the first position PC1 to the second position PC2 relative to the gland 7 in the circumferential direction C0 may be direct rotation of the head cap 6 from the first position PC1 to the second position PC2. The switching of the head cap 6 from the first position PC1 to the second position PC2 relative to the gland 7 may also be that the head cap 6 moves relative to the gland 7 in the vertical direction X1 and then rotates. For example, in the illustrated implementation, as will be mentioned below, the head cap 6 first moves upwardly relative to the gland 7 in the vertical direction X1 from the state of FIG. 15, then rotates, and after that, moves downwardly to the state of FIG. 14 in the vertical direction X1.

As shown in FIG. 13, the outer columnar surface 811 of the adapter column 81 may include two arc columnar surfaces 813 distributed symmetrically with respect to a first line of symmetry L1. The outer columnar surface 811 of the adapter column 81 may also include two avoidance columnar surfaces 814 distributed symmetrically with respect to a second line of symmetry L2. The first line of symmetry L1 and the second line of symmetry L2 may be perpendicular to each other. In this way, the head cap 6 may rotate from the first position PC1 to the second position PC2 in both reverse and forward rotations, making it more convenient to operate.

The recess 812 may be provided on each of the two arc columnar surfaces 813. In addition, the recesses 812 of the two arc columnar surfaces 813 may also be symmetrically distributed with respect to the first line of symmetry L1. Further, the adapter hole 82 may be provided with two protrusions 822, and in the first position PC1, the two protrusions 822 may be snapped into the recesses 812 of the two arc columnar surfaces 813 respectively, as shown in FIG. 15.

In the illustrated implementation, the protrusion 822 may be elastic, and for example, may be made of a plastic material having certain elasticity. This elasticity causes the protrusion 822 to disengage from the recess 812 in the vertical direction X1 under a predetermined external force. For example, the protrusion 822 may disengage from the recess 812 by manually pulling the head cap 6 upwardly. For example, the predetermined external force may be 10 N or less. Further, the recess 812 may also limit the movement of the head cap 6 relative to the gland 7 in the circumferential direction. For example, the recess 812 may be in the form of a pit, as shown in FIG. 7.

In this case, the head cap 6 may be pulled manually to cause the protrusion 822 to disengage from the recess 812, then the head cap 6 (the pressing rod 2) is caused to rotate relative to the gland 7 to a position where the protrusion 822 corresponds to the avoidance space S6, and after that, both of the pressing rod 2 and the head cap 6 may move freely up and down relative to the gland 7.

In another implementation, the recess 812 may be a groove extending in the circumferential direction C0, such that the protrusion 822 may naturally disengage from the groove when the head cap 6 rotates from the first position PC1 to the second position PC2. In this case, the head cap 6 (the pressing rod 2) may be rotated relative to the gland 7 such that the protrusion 822 disengages from the recess 812 and reaches the avoidance space S6. Thereafter, both of the pressing rod 2 and the head cap 6 may move freely up and down relative to the gland 7.

In the illustrated implementation, the gland 7 may also be provided with a base column 83. The adapter column 81 may protrude from a top end of the base column 83. The base column 83 may be provided with a threaded hole 831. The adapter column 81 is provided with a central hole 810. The threaded hole 831 may be in communication with the central hole 810 and takes a center line of the central hole 810 as a central axis (both shown as O1). The gland 7 may be in threaded connection with a bottleneck 201 of the container body 20 by means of the threaded hole 831. In addition, the pressing rod 2 may sequentially pass through the central hole 810 of the adapter column 81, and the bottleneck 201 surrounded by the threaded hole 831 of the gland 7 to reach an interior of the container body 20.

The aforementioned gland assembly has a simple and compact structure, is easy to produce, has a low manufacturing cost, and can easily switch the pressing rod from being held in place to being flexibly pressed.

As an example, the head cap 6 may be pressed to the bottom together with the pressing rod 2 and the built-in member 1 in advance, as shown in FIG. 1A. The state shown in FIG. 1A may be used as an initial packaged state of the container 100. In this case, the protrusion 822 of the head cap 6 may be snapped into the recess 812 of the gland 7, such that the container 100 can be locked in the initial packaged state.

When there is a need for use, the user may pull the head cap 6 upwardly, such that the elastic protrusion 822 deforms to some extent to disengage from the recess 812, thus reaching the state as shown in FIG. 1B. In this case, each of the head cap 6, the pressing rod 2, and the built-in member 1 may be in the highest position.

Figure 5B:
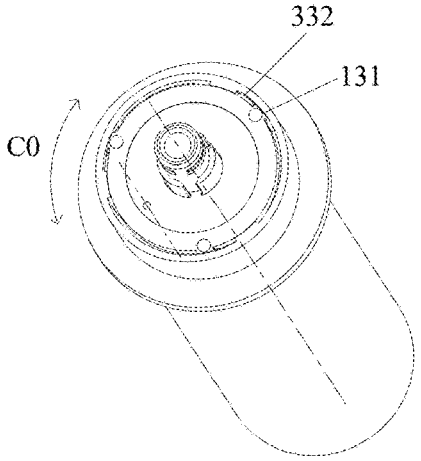
FIG. 5B is a schematic diagram showing that the slider of the outer cylinder wall of the built-in member slides from the state of FIG. 5A onto a circumferential sliding groove of the outer cylinder housing of the main housing.
Figure 5C:
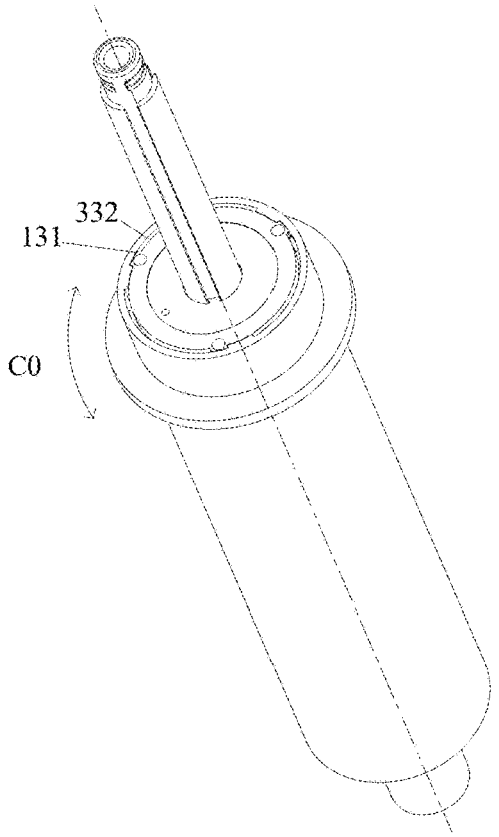
FIG. 5C is a schematic diagram showing that the slider of the outer cylinder wall of the built-in member further slides from the state of FIG. 5B to be locked onto the circumferential sliding groove.

After that, the head cap 6 may be rotated together with the pressing rod 2 and the built-in member 1, as can be seen with reference to FIGS. 5A, 5B and 5C. During this rotation, the slider 131 of the built-in member 1 rotates from the top end of the vertical sliding groove 331 to the circumferential sliding groove 332 to be suspended, and may further cross over the protrusion 3321 in the circumferential sliding groove 332 to be locked between a side wall of the circumferential sliding groove 332 and the protrusion 3321, such that the built-in member 1 can be locked in the highest position. Moreover, after this rotation, the head cap 6 and the pressing rod 2 may rotate relative to the gland 7 and the container body 20 to a position where the protrusion 822 of the head cap 6 corresponds to the avoidance space S6.

After the built-in member 1 is locked at the highest position, the protrusion 822 of the head cap 6 is located on an upper side of the avoidance space S6, and thus the head cap 6 together with the pressing rod 2 can be freely pressed up and down relative to the gland 7 and the container body 20.

Although the present invention is disclosed as above in terms of the preferred embodiments, they are not intended to limit the present invention, and those skilled in the art could all make possible changes and alterations without departing from the spirit and scope of the present invention. Hence, any alterations, equivalent changes and modifications, which are made to the above embodiments based on the technical essence of the present invention without departing from the content of the technical solutions of the present invention, shall fall within the scope of protection defined by the claims of the present invention.

The invention claimed is:

1. A pump assembly, which is suitable for being mounted on a container body and comprises a pressing rod, the pressing rod having a rod body, a connecting part bottom wall, a connecting part side wall and a piston part, a lower end of the rod body being connected to the connecting part bottom wall, and the connecting part side wall protruding upwardly from the connecting part bottom wall and being arranged at a periphery of the rod body, the pump assembly comprising:

a main housing having a bottom housing, an inner cylinder housing and an outer cylinder housing, the inner cylinder housing and the outer cylinder housing both protruding upwardly from the bottom housing, the inner cylinder housing defining a cylindrical chamber, the outer cylinder housing being located at a periphery of the inner cylinder housing and defining an annular space with the inner cylinder housing, and the bottom housing being provided with a pumping port, in communication with the container body, in an intermediate part defined by the inner cylinder housing; and a built-in member having a top housing wall, an inner cylinder wall and an outer cylinder wall, the inner cylinder wall and the outer cylinder wall both protruding downwardly from the top housing wall, the inner cylinder wall defining a through hole for the rod body to pass through, and the outer cylinder wall being located at a periphery of the inner cylinder wall and defining an annular chamber with the inner cylinder wall;

wherein the connecting part bottom wall is arranged in the cylindrical chamber, the connecting part side wall is in slidably sealing contact with an inner wall surface of the inner cylinder housing, and the piston part is arranged in the annular chamber and is in slidably sealing contact with each of an outer wall surface of the inner cylinder wall and an inner wall surface of the outer cylinder wall; and the built-in member is configured to be movable in the outer cylinder housing from a lower position in which the outer cylinder wall of the built-in member is at least partially located in the annular space to a higher position in which the built-in member is arranged to be locked by means of a locking structure.

2. The pump assembly according to claim 1, wherein the outer cylinder wall and the outer cylinder housing are in sliding fit by sliding a slider in a vertical sliding groove, and the slider and the vertical sliding groove are arranged on a first one and a second one of an outer wall surface of the outer cylinder wall and an inner wall surface of the outer cylinder housing respectively.

3. The pump assembly according to claim 2, wherein the second one is provided with a circumferential sliding groove, the circumferential sliding groove being in communication with the vertical sliding groove, and in the higher position, the built-in member is locked in the higher position by sliding the slider into the circumferential sliding groove in a circumferential direction, wherein the slider and the circumferential sliding groove constitute the locking structure.

4. The pump assembly according to claim 3, wherein a protrusion is provided in the circumferential sliding groove, the protrusion having a side surface that gradually becomes higher from a proximal side to a distal side of the vertical sliding groove in the circumferential direction.

5. The pump assembly according to claim 1, wherein a raised strip extending in a vertical direction is provided on a first one of an inner wall surface of the inner cylinder wall and an outer peripheral surface of the rod body, and a groove in sliding fit with the raised strip is provided in a second one of the inner wall surface of the inner cylinder wall and the outer peripheral surface of the rod body.

6. The pump assembly according to claim 2, wherein the first one is the outer wall surface of the outer cylinder wall.

7. The pump assembly according to claim 2, wherein the pump assembly comprises a plurality of sliders distributed in a circumferential direction and a plurality of corresponding vertical sliding grooves.

8. The pump assembly according to claim 1, wherein the pump assembly is configured, when the built-in member is in the lower position, to allow:

the connecting part bottom wall of the pressing rod to abut against the bottom housing of the main housing, and a lower end of the outer cylinder wall of the built-in member to have a gap with the bottom housing in a vertical direction; and/or the piston part of the pressing rod to abut against the top housing wall of the built-in member and to be located above the inner cylinder housing of the main housing.

9. The pump assembly according to claim 1, wherein the pump assembly is configured, when the built-in member is located in the higher position, to allow:

the pressing rod to move downwardly relative to the built-in member to abut against the bottom housing of the main housing, while the piston part to be always in sealing contact with each of the outer wall surface of the inner cylinder wall and the inner wall surface of the outer cylinder wall; and/or a height difference between lower ends of the inner cylinder wall and the outer cylinder wall of the built-in member and an upper end of the inner cylinder housing of the main housing to be less than 10% of a height of the outer cylinder housing.

10. A container with a content discharge function and having a container body, the container comprising a pump assembly according to claim 1, the pump assembly being mounted on the container body and configured to discharge a content in the container body.

* * * * *